US007097067B2

(12) United States Patent
Scarabelli et al.

(10) Patent No.: US 7,097,067 B2
(45) Date of Patent: Aug. 29, 2006

(54) HERMETICALLY SEALABLE CONTAINER WITH INTERNAL PARTIAL VACUUM MAKING FACILITIES

(76) Inventors: Dionisio Scarabelli, Via della Repubblica, 50/B, 24060 Cividino Di Castelli Calepio (IT); Enrico Scarabelli, Via G. Verdi, 7, 24060 Telgate (IT); Marino Scarabelli, Via San Rocco, 8, 24060 Telgate (IT)

( * ) Notice: Subject to any disclaimer, the term of this patent is extended or adjusted under 35 U.S.C. 154(b) by 0 days.

(21) Appl. No.: 10/190,710

(22) Filed: Jul. 9, 2002

(65) Prior Publication Data

US 2003/0019877 A1 Jan. 30, 2003

(30) Foreign Application Priority Data

Jul. 25, 2001 (IT) ..... MI2001A1609

(51) Int. Cl.
*B65D 43/08* (2006.01)
*B65D 51/16* (2006.01)
*B65D 43/06* (2006.01)

(52) U.S. Cl. ..... 220/796; 220/231; 220/360; 220/366.1

(58) Field of Classification Search ..... 220/796, 220/366.1, 203.29, 203.09, 793, 805, 360, 220/231, 661, 240, 802, 785, 720, 721, 203.1, 220/203.04
See application file for complete search history.

(56) References Cited

U.S. PATENT DOCUMENTS

| | | | | | |
|---|---|---|---|---|---|
| 2,162,853 | A | * | 6/1939 | Massey | 229/5.5 |
| 2,340,024 | A | * | 1/1944 | Skaller | 206/440 |
| 3,173,571 | A | | 3/1965 | Cserny et al. | |
| 3,698,783 | A | * | 10/1972 | Swett et al. | 312/351 |
| 4,341,324 | A | * | 7/1982 | Ramirez | 220/796 |
| 4,471,880 | A | | 9/1984 | Dilyard et al. | |
| 5,065,889 | A | * | 11/1991 | Conti | 220/360 |
| 5,147,059 | A | * | 9/1992 | Olsen et al. | 220/281 |
| 5,340,741 | A | * | 8/1994 | Lemonnier | 435/287.4 |
| 5,587,192 | A | * | 12/1996 | Beizermann | 426/118 |
| 6,051,263 | A | * | 4/2000 | Gorlich et al. | 426/129 |
| 6,142,332 | A | * | 11/2000 | Ferrara | 220/212 |
| 6,372,273 | B1 | * | 4/2002 | Mabry et al. | 426/129 |
| 6,877,625 | B1 | * | 4/2005 | Alley | 215/307 |

FOREIGN PATENT DOCUMENTS

| | | | | |
|---|---|---|---|---|
| AU | 152000 | * | 8/1952 | 220/366.1 |
| DE | 10 56 494 | | 4/1959 | |
| FR | 772884 | * | 11/1934 | 220/366.1 |
| FR | 1047348 | * | 12/1953 | 220/366.1 |
| FR | 1 115 331 | | 4/1956 | |
| WO | 00 06459 | | 2/2000 | |

* cited by examiner

*Primary Examiner*—Nathan J. Newhouse
*Assistant Examiner*—Niki M. Eloshway
(74) *Attorney, Agent, or Firm*—Modiano & Associati; Albert Josif; Daniel O'Byrne

(57) ABSTRACT

A hermetically sealable container with internal partial vacuum making facilities, comprising a base body with which a lid is hermetically associable, the lid having, at least in its peripheral region, an elastically flexible portion that has a groove arranged peripherally and open toward the edge of the base body. On the edge of the base body, at least one through hole is provided, arranged at a distance from the free border of the edge of the base body that is shorter than the depth of the groove.

6 Claims, 2 Drawing Sheets

HERMETICALLY SEALABLE CONTAINER WITH INTERNAL PARTIAL VACUUM MAKING FACILITIES

BACKGROUND OF THE INVENTION

The present invention relates to a hermetically sealable container with means for producing an internal partial vacuum.

As is known, containers generally used to preserve foodstuffs are already commercially available which can be closed hermetically and have a lid, usually made of flexible material, which is flexible so that it is possible to expel a certain amount of air during closure, so that when the lid is released a partial vacuum is produced inside the container.

In the prior art devices, the air expulsion step must be performed with the lid on, with the lid groove for forming a seal with the edge of the base body having to remain, at least in some portions, spaced from the edge of the base body. Therefore during the final step of the lid closure a certain amount of previously expelled air often reenters the container, consequently reducing is the partial vacuum.

Another problem noted in the containers of the prior art is that a certain skill is required from the users in order to achieve correct closure.

SUMMARY OF THE INVENTION

The aim of the present invention is to solve the above described drawbacks by providing a hermetically sealable container with means for producing an internal partial vacuum, which allows to provide a high partial vacuum by utilizing a new and innovative principle that prevents air from reentering the container even partially during the final step of the closure of the lid.

Within this aim, an object of the present invention is to provide a hermetically sealable container that can be closed simply and rapidly without requiring particular skill on the part of the user.

Another object of the invention is to provide a hermetically sealable container that thanks to its particular constructive characteristics is capable of giving the greatest assurances of reliability and safety in use and is also competitive from a merely economical standpoint.

This aim and these and other objects that will become better apparent hereinafter are achieved by a hermetically sealable container with means for producing an internal partial vacuum, according to the invention, comprising a base body with which a lid is hermetically associable, such lid having, at least in its peripheral region, an elastically flexible portion that has a groove that is arranged peripherally and is open toward the edge of said base body, characterized in that it comprises, on said edge of the base body, at least one through hole arranged at a distance from the free border of said edge of the base body that is shorter than the depth of said groove.

BRIEF DESCRIPTION OF THE DRAWINGS

Further characteristics and advantages of the present invention will become better apparent from the following detailed description of a preferred but not exclusive embodiment of a hermetically sealable container with means for producing an internal partial vacuum, illustrated by way of non-limitative example in the accompanying drawings, wherein.

DESCRIPTION OF THE PREFERRED EMBODIMENTS

Figure 1:
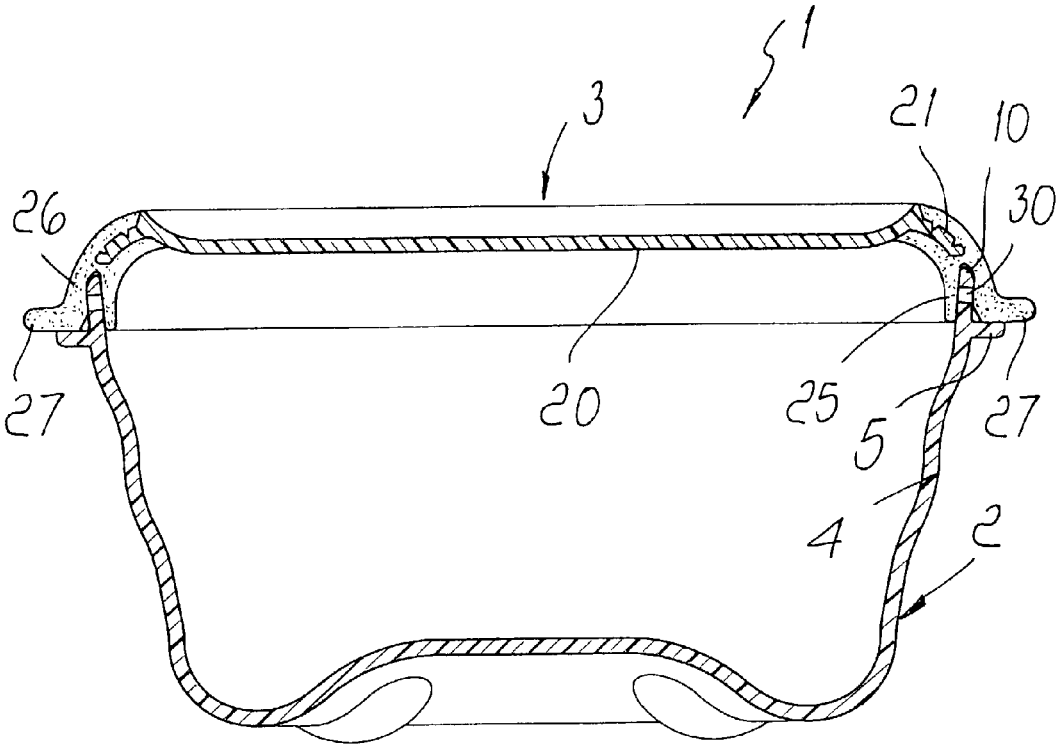
FIG. 1 is a schematic transverse sectional view of a container according to the invention.

With reference to the figures, the hermetically sealable container with means for producing an internal partial vacuum, according to the invention, generally designated by the reference numeral 1, comprises a base body 2 to which a lid, designated by the reference numeral 3, can be applied hermetically.

The base body 2 preferably but not necessarily has walls with a lateral surface 4 which are inclined outwardly and have a substantially sinusoidal profile.

Satin-finished bands and clear bands can be provided alternately on the walls in order to better view the contents of the container.

Figure 2:
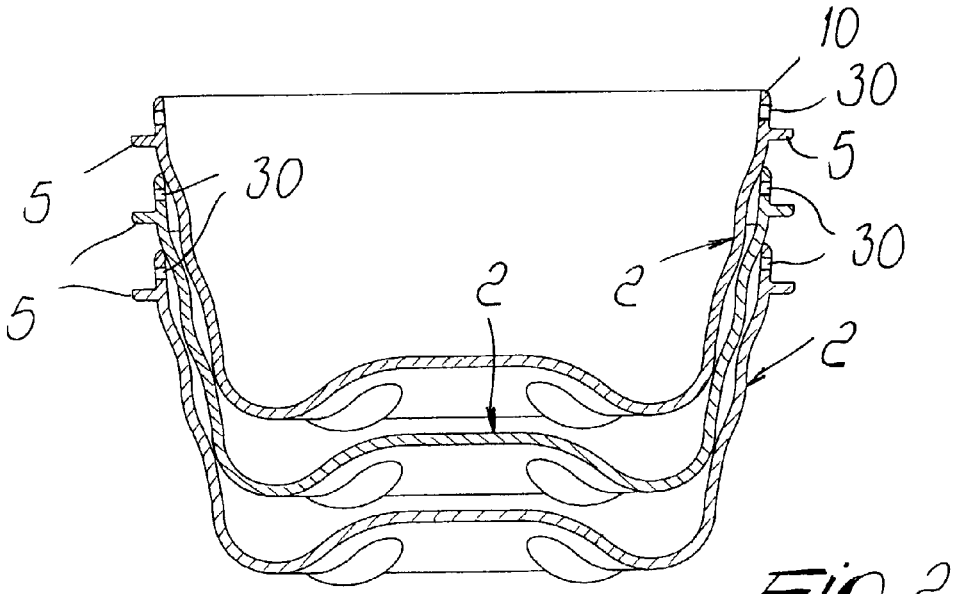
FIG. 2 is a schematic view of multiple mutually stacked base bodies.

The sinusoidal shape of the walls, together with their inclination, allows easy stacking of multiple containers, as shown schematically in FIG. 2.

Proximate to the upper part, the container has an edge 10 at which there is an external horizontal peripheral rim 5, that runs along the entire peripheral region of the base body 2.

The lid 3 is preferably but not necessarily provided with a central portion 20 that is substantially rigid and is delimited by a tab 21, which protrudes along the circumference of the lid and extends radially up to, and so that it does not protrude with respect to, the region delimited by the edge 10 of the base body, both internally and externally.

A flexible portion 22 is applied at the tab 21, is arranged peripherally and defines a peripheral groove 23 that is open toward the edge 10 of the base body.

The groove 23 is delimited by an internal or inner lip 25 and by an external or outer lip 26, which ends with a circumferential wing 27 which, when the container is in the closed position, is designed to be arranged in abutment against the rim 5 formed by the base body 2.

The particular characteristic of the invention is that at the edge 10 there is at least one, but preferably a plurality of through holes 30 designed to allow the outward release of the air contained in the container by applying to the lid a pressure that produces expulsion.

Figure 3:
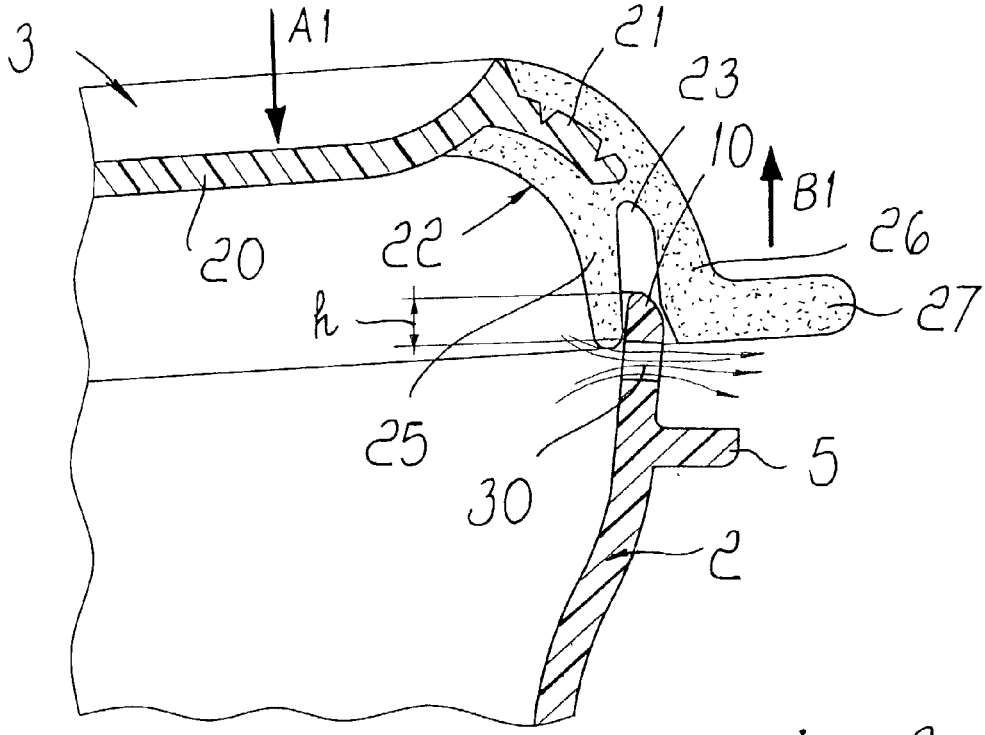
FIG. 3 is an enlarged-scale sectional view of the detail of the step in which pressure is applied to the lid in order to place it in partial vacuum.
Figure 4:
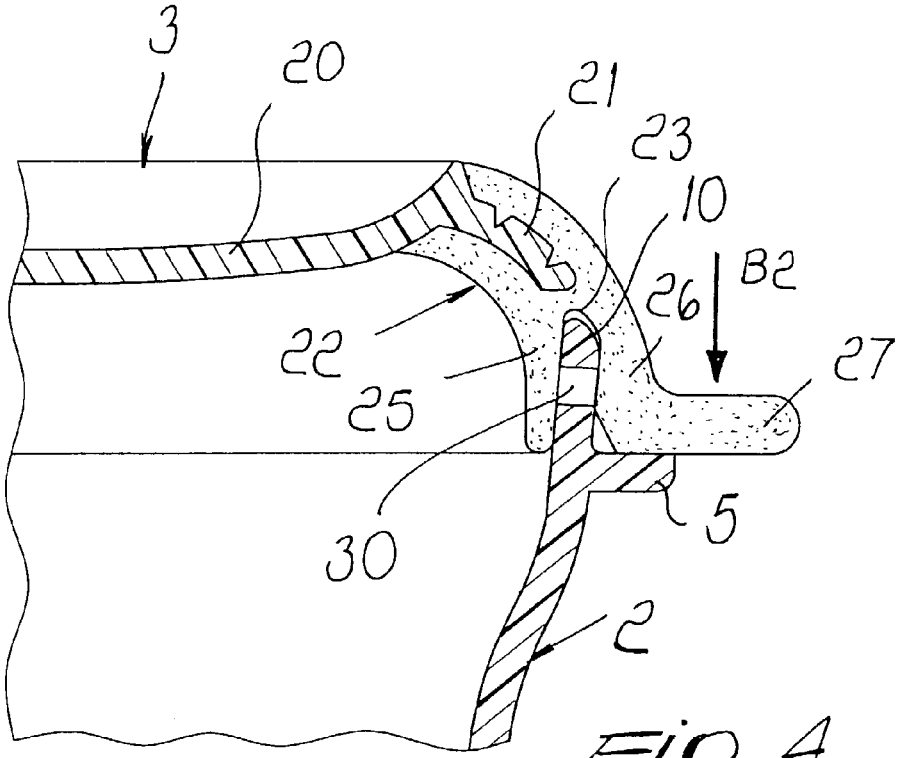
FIG. 4 is a sectional view of the detail of the hermetically closed container.

To close the container hermetically by means of the lid, it is sufficient to apply pressure in the direction of the arrow A1 of FIG. 3 and simultaneously pull upward with a movement B1, so as to arrange the lid slightly at an angle on the base body and so that the groove engages the free border of the edge 10 of the base body.

In this condition, the lid is applied in practice hermetically with respect to the edge, but leaves free the hole 30, since the inner and outer lips 25 and 26 are spaced from the holes or in any case from at least one hole formed in the edge 10.

By applying pressure, the air is pushed so as to exit from the hole or holes that remain open.

When force is applied along the direction B2, the lid is closed completely and the lips 25 and 26 cover the through holes 30.

It should be observed that the flexing of the outer lip 26 produced by applying the force in the directions A1 and B1 preferably forms an angle, of the wall of the outer lip 26 that faces the groove 23 with respect to a vertical direction of the resting surface of the container or lid, which can be estimated at approximately 7–9°.

With this operation, the container is closed hermetically and the air inside it is in partial vacuum.

The presence of the holes 30 provides facilities or means that allow to expel more air than in conventional containers of equal shape and size, since in known containers in order to allow the excess air to flow out it is necessary to leave an opening between the upper edge of the container and the lid, and therefore air may reenter while the lid is being closed.

Moreover, with the described arrangement a larger amount of air is expelled; this amount can be estimated roughly as approximately half of the product of the surface and the distance h between the free border of the edge 10 and the upper portion of the holes 30.

With the described arrangement a higher partial vacuum and accordingly a better hermetic closure is therefore obtained.

With the above described arrangement, and particularly by using a lid that has a rigid central portion, it is possible to introduce directly the container with the lid, from a refrigerator or freezer, into a microwave oven without running the risk of expulsion or explosion, since any pressure on the inner surface of the lid generated by the steam produced during heating causes the tab 21 to oscillate, consequently divaricating inward the inner lip 25 and allowing to vent the steam through the holes, and therefore the cover is not subjected to expulsion pressure.

It is thus evident from the above description that the invention achieves the intended aim and objects and in particular the fact is stressed that the adoption of a constructively simple solution such as the provision of holes on the edge allows to already couple the lid hermetically to the base body yet still be able to continue expelling the air.

Moreover, the elastic lips that form the groove in which the edge of the base body is accommodated are able to apply a perfect hermetic closure.

The invention thus conceived is susceptible of numerous modifications and variations, all of which are within the scope of the appended claims.

All the details may further be replaced with other technically equivalent elements.

In practice, the materials used, so long as they are compatible with the specific use, as well as the contingent shapes and dimensions, may be any according to requirements.

The disclosures in Italian Patent Application No. MI2001A001609 from which this application claims priority are incorporated herein by reference.

What is claimed is:

1. A hermetically sealable foodstuffs preserving container with internal partial vacuum making facilities for foodstuffs preserving, comprising:

a base body for containing and preserving foodstuffs and having an edge with a free border;

a flexible lid hermetically connectable with said base body, said lid having, at least in a peripheral region thereof, an elastically flexible portion for expelling air from said base body upon flexing of said lid;

a circumferential wing that acts as a grip element for lifting an edge part of the flexible portion during a compression of a central portion of the lid for expelling air from said base body for producing in the container an internal partial vacuum;

a groove provided at said flexible portion of the lid, peripherally thereto so as to be open toward the edge of said base body; and at least one through hole arranged at said edge of the base body, at a distance below a top free border of said edge that is shorter than a depth of said groove;

such that said lid is arranged on said base body so as to mate hermetically, during said compression of said central portion of the lid for expelling air from said base body for producing in the container the internal partial vacuum, with said edge in a region thereof that lies above said at least one through hole while simultaneously allowing air to escape from inside said base body outwardly through said at least one through hole to form the partial vacuum inside said container.

2. The container of claim 1, wherein said lid comprises a substantially rigid central portion, a tab that delimits said rigid central portion peripherally, said tab protruding radially up to, and no further than a region of said base body delimited by said edge.

3. The container of claim 2, wherein said flexible portion of the lid comprises an inner lip and an outer lip, which delimit said groove.

4. The container according of claim 3, wherein said circumferential wing is provided on said outer lip.

5. The container of claim 4, wherein said base body has a peripheral rim that is engageable with said circumferential wing of said outer lip when said lid is coupled hermetically to said base liody.

6. The container of claim 3, wherein said outer lip is inclined substantially at 7–9° with respect to a vertical direction of the edge of the base body, when the container is under partial vacuum.

* * * * *